US006739896B2

(12) United States Patent
Sivertsen

(10) Patent No.: US 6,739,896 B2
(45) Date of Patent: May 25, 2004

(54) CABLE RETENTION APPARATUS

(75) Inventor: Clas Gerhard Sivertsen, Lilburn, GA (US)

(73) Assignee: American Megatrends, Inc., Norcross, GA (US)

( * ) Notice: Subject to any disclaimer, the term of this patent is extended or adjusted under 35 U.S.C. 154(b) by 0 days.

(21) Appl. No.: 10/141,711

(22) Filed: May 9, 2002

(65) Prior Publication Data

US 2003/0209361 A1 Nov. 13, 2003

(51) Int. Cl.[7] ..... H01R 13/62
(52) U.S. Cl. ..... 439/371; 174/135; 439/372
(58) Field of Search ..... 174/135; 439/368, 439/371, 372, 373; 361/788, 825, 826

(56) References Cited

U.S. PATENT DOCUMENTS 2,266,560 A * 12/1941 Mansfield ..... 439/368
4,154,495 A * 5/1979 Crewse ..... 439/373
4,671,594 A * 6/1987 Ohtsuki et al. ..... 439/372
5,174,781 A * 12/1992 Muzslay ..... 439/370
5,401,179 A * 3/1995 Shinchi et al. ..... 439/372
5,593,313 A * 1/1997 Shibuya et al. ..... 439/372
5,603,624 A * 2/1997 Taguchi et al. ..... 439/372
5,797,758 A * 8/1998 Tsuchiya et al. ..... 439/372
5,860,827 A * 1/1999 Lee ..... 439/373
5,938,468 A * 8/1999 Lin ..... 439/372
6,193,531 B1 * 2/2001 Ito et al. ..... 439/372
6,273,756 B1 * 8/2001 Ward et al. ..... 439/372
6,327,159 B1 * 12/2001 Davies et al. ..... 361/788
6,447,312 B1 * 9/2002 Takata ..... 439/157
6,475,017 B1 * 11/2002 Wu ..... 439/372

* cited by examiner

*Primary Examiner*—Dean A. Reichard
*Assistant Examiner*—Adolfo Nino
(74) *Attorney, Agent, or Firm*—Merchant & Gould

(57) ABSTRACT

A cable retention apparatus is provided for an electronic device. The electronic device has a power supply receptacle for holding a power supply cable. The cable retention apparatus includes an arm, which is pivotally connected to the electronic device. An integrated locking member extending from the arm is used to engage the arm with a portion of the power supply cable when the arm is pivoted from an unlocked position away from the cable to a locked position with the cable so that the cable is prevented from being removed from the receptacle.

19 Claims, 4 Drawing Sheets

CABLE RETENTION APPARATUS

FIELD OF THE INVENTION

This invention relates generally to a cable retention apparatus for a power supply, and more particularly, to an apparatus for preventing a power supply cable from being removed from the power supply of an electronic device.

BACKGROUND OF THE INVENTION

Electronic devices, such as computers, utilize power supply cables to receive power for operation. Typically, one end of the power supply cable is plugged into the power supply of the device and the other end is plugged into a power source. Computer networks, such as the Internet, utilize electronic devices that require a continuous supply of power for managing resources for one or more users. That is, these devices must always be operating so that the needs of network users are met. An example of one such electronic device is a server which may be used to store files on a network.

A server typically contains a power supply which receives power from an associated power supply cable. The power supply in turn, supplies power to other devices in the server requiring power such as disk drives. The devices in the server may also be hot-swappable so that they may be exchanged without removing power from the server. Larger computer networks require multiple servers which may be stacked together in a rack (i.e., rack-mounted) to save space.

Access is gained to a rack-mounted server (e.g., for hot-swapping a disk drive) by pulling it out from the rack. When a server is pulled out from the rack, however, strain is placed on the power supply cable. The strain may be increased if there are several devices mounted in the rack in such a fashion that the power cables become entangled. As a result, when the server is removed, the power supply cable may be unintentionally removed from the power supply, thereby resulting in an unexpected loss of power to the server and downtime for the network.

Other types of electronic devices also suffer from similar power loss when the power supply cable is unintentionally removed from the power supply due to excessive strain. Accordingly, there is a need in the art for an apparatus for retaining a power supply cable in the power supply of an electronic device.

It is with respect to these considerations and others that the present invention has been made.

SUMMARY OF THE INVENTION

In accordance with illustrative embodiments of the present invention, the above problem is solved by a cable retention apparatus for retaining a power supply cable in the power supply of an electronic device. The power supply has a receptacle for holding a power supply cable. The cable retention apparatus consists of an arm which is pivotally connected to the power supply. An integrated locking member extending from the arm is used to engage the arm with a portion of the power supply cable when the arm is pivoted from an unlocked position away from the cable to a locked position with the cable so that the cable is prevented from being removed from the power supply.

In accordance with one actual embodiment of the invention, retaining brackets, which may be either attached or integrated with the power supply, may be used to receive the ends of the arm to enable the arm to pivot towards the power supply receptacle. In accordance with other embodiments of the invention, the electronic device containing the power supply may be a rack-mounted server computer.

These and other features and advantages, which characterize various embodiments of the present invention, will be apparent from a reading of the following detailed description and a review of the associated drawings. It is to be understood that both the foregoing general description and the following detailed description are illustrative and explanatory only and are not restrictive of the invention, as claimed.

DETAILED DESCRIPTION OF AN ILLUSTRATIVE EMBODIMENT

As discussed briefly above, embodiments of the invention provide a cable retention apparatus for preventing the accidental removal of a power supply cable from the power supply of an electronic device, such as a server computer. For example, if a server is pulled out of a mounting rack to hot swap a disk drive device, the cable retention apparatus operates to keep the cable engaged with the power supply. In this manner, the apparatus provided herein ensures that power is not disconnected from the server's power supply. Additionally, the apparatus provided according to one embodiment of the present invention may be included as part of a system for installation to a rack-mounted server.

Figure 1:
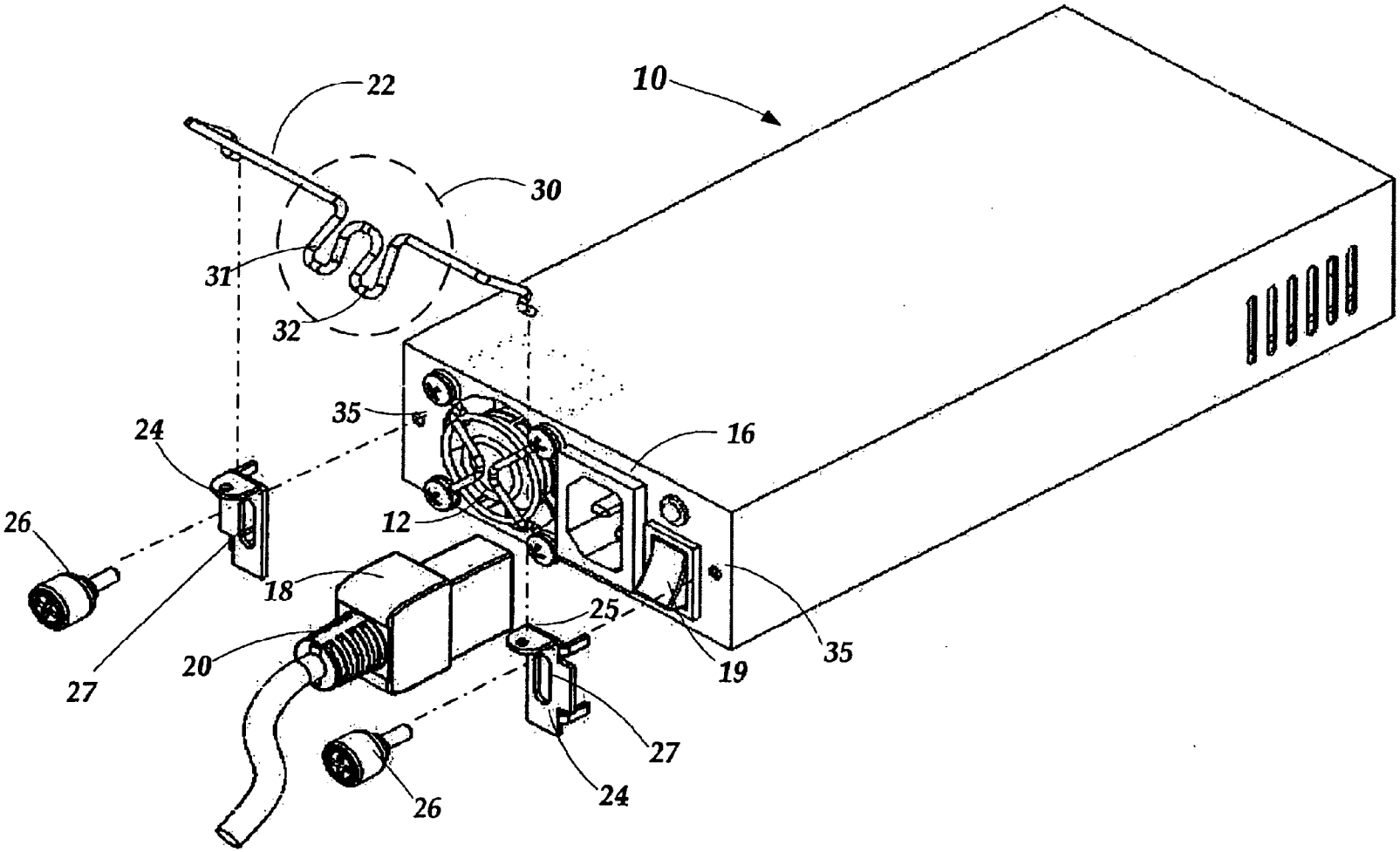
FIG. 1 is an exploded view illustrating components of the present invention in an illustrative operating environment for the present invention.

Referring now to the drawings, in which like numerals represent like elements throughout the several figures, aspects of the present invention will be described. FIG. 1 is an exploded view illustrating components of the present invention in an illustrative operating environment. In particular, FIG. 1 shows a typical power supply 10 for use in an electronic device such as a server computer network (not shown).

The various components of the power supply 10 are well known to those skilled in the art and may include a fan 12, power switch 19, and power cable receptacle 16. As shown in FIG. 1, power cable receptacle 16 is connected to the power supply 10. The power supply 10 receives AC power from the power supply cable 18 through the power cable receptacle 16. In a server environment, power supply 10 may be utilized to supply power to various devices contained within the server such as disk drives (not shown) for storing files. As is well known to those skilled in the art, the cable 18 may optionally include a strain relief 20 for reducing the stress placed on the cable when it is pulled from the power cable receptacle 16.

FIG. 1 also shows retaining brackets 24 removably attached to the power supply 10. Brackets 24 contain pivot holes 25 and channels 27. The pivot holes 25 pivotally connect the retention arm 22 to the retaining brackets 24. The operation of the arm 22 in conjunction with the pivot holes 25 will be described in greater detail below with respect to FIGS. 2–4. The channels 27 provide a mounting location through which the retaining screws 26 may be inserted, thereby securely fastening the retaining brackets 24 to the power supply 10. The channels 27 also allow vertical movement of the brackets 24 when attached to the power supply 10, thereby providing a range of mounting locations for the arm 22.

It will be appreciated by those skilled in the art that some or all of the components illustrated in FIG. 1, including, but not limited to, the retention arm 22, the retention brackets 24 and the retaining screws 26 may comprise a system for attachment to any conventional power supply for use in a rack mounted server or other type of electronic device. Moreover, it should be understood to those skilled in the art that the components illustrated in FIG. 1 are illustrative only and are not restrictive of the invention claimed herein. For example, portions of the functionality of some of the components (e.g., the retaining brackets) may be incorporated into the power supply 10. Furthermore, the arm 22 may be utilized with a power cable without a strain relief.

Figure 2:
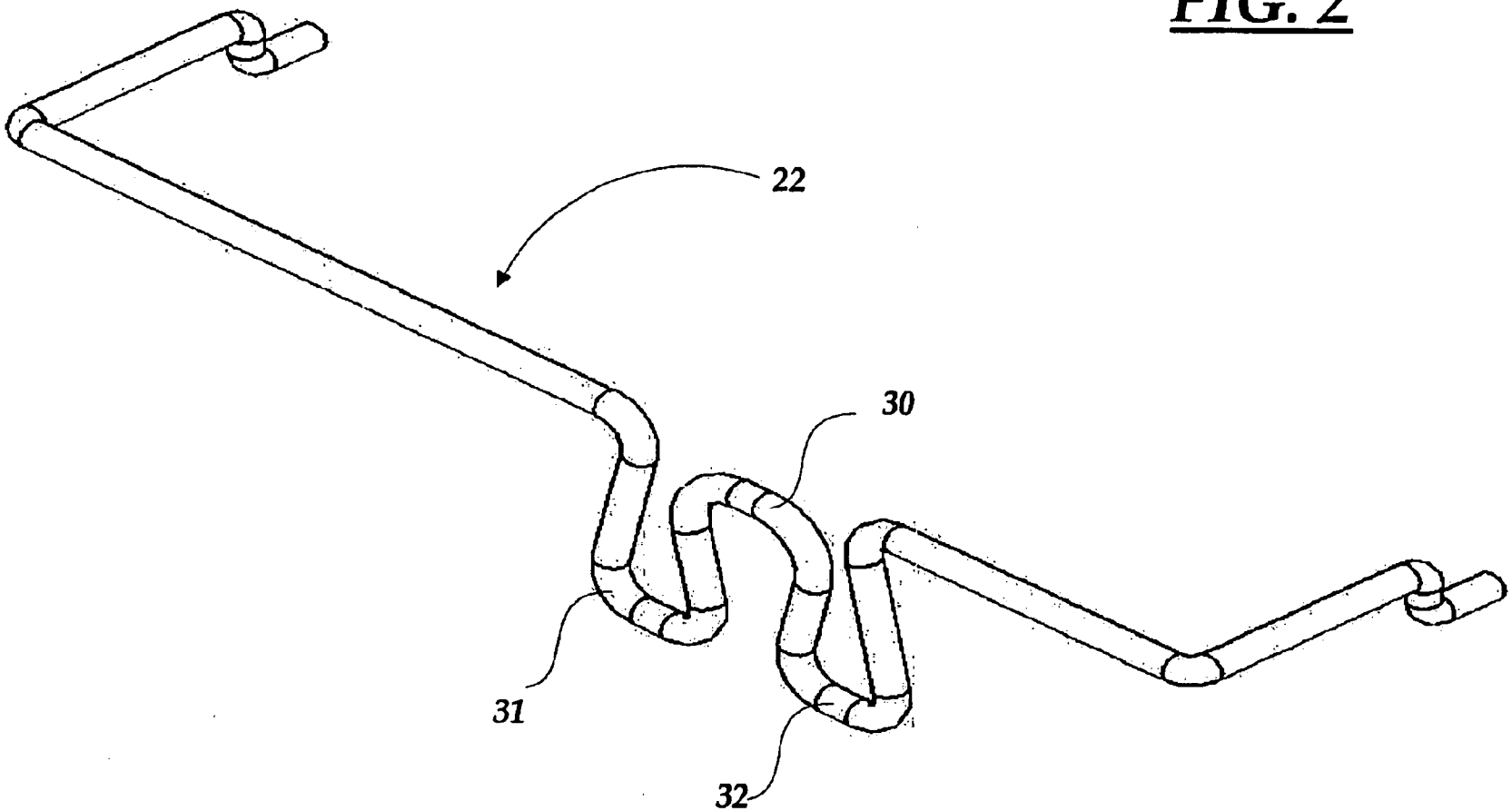
FIG. 2 is a perspective view of a retention arm utilized in accordance with an illustrative embodiment of the invention.

FIG. 2 is a perspective view of the retention arm 22 in accordance with an illustrative embodiment of the invention. As shown in FIG. 2, the retention arm 22 includes an integrated locking member 30 for locking the arm 22 with the cable 18 (shown in FIG. 1). According to one embodiment of the invention, the locking member 30 includes two retaining tabs 31 and 32 for engaging each side of the cable 20 when the retention arm 22 is in a locked position. It should be understood by those skilled in the art that locking member 30 and the retaining tabs 31 and 32 may be constructed as a single piece. However, the arm 22 and the locking member 30 may be constructed from several pieces of material. For instance, the retaining tabs 31 and 32 may be constructed separately from the arm 22 and attached to the arm 22. Moreover, the retaining tabs 31 and 32 may be configured in different shapes than those shown in FIG. 2. For instance, the tabs 31 and 32 may be constructed as square or rectangular tabs. Other configurations will be apparent to those skilled in the art.

Figure 3:
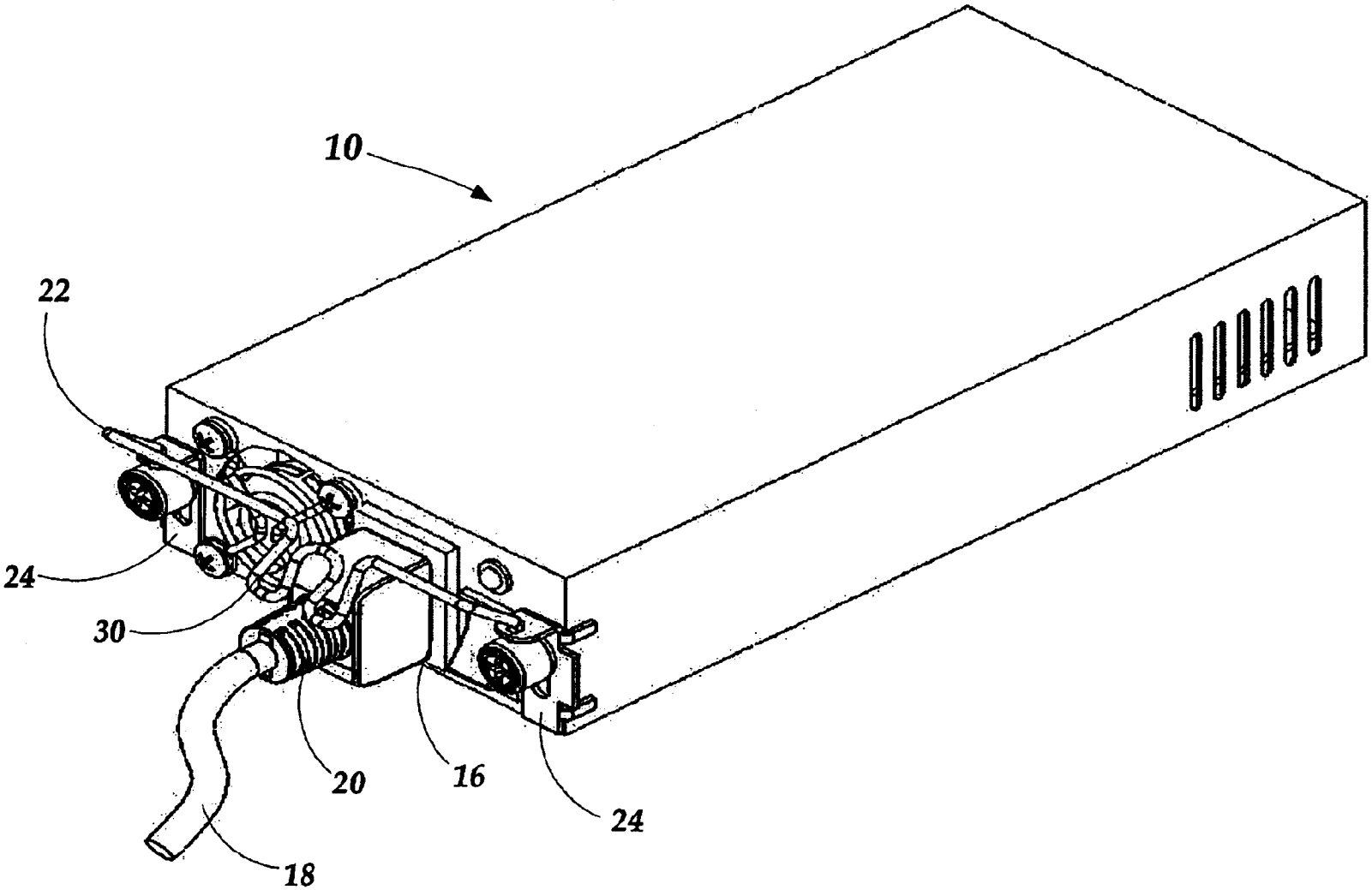
FIG. 3 is a perspective view of the retention arm in an unlocked position in an illustrative operating environment for the present invention.
Figure 4:
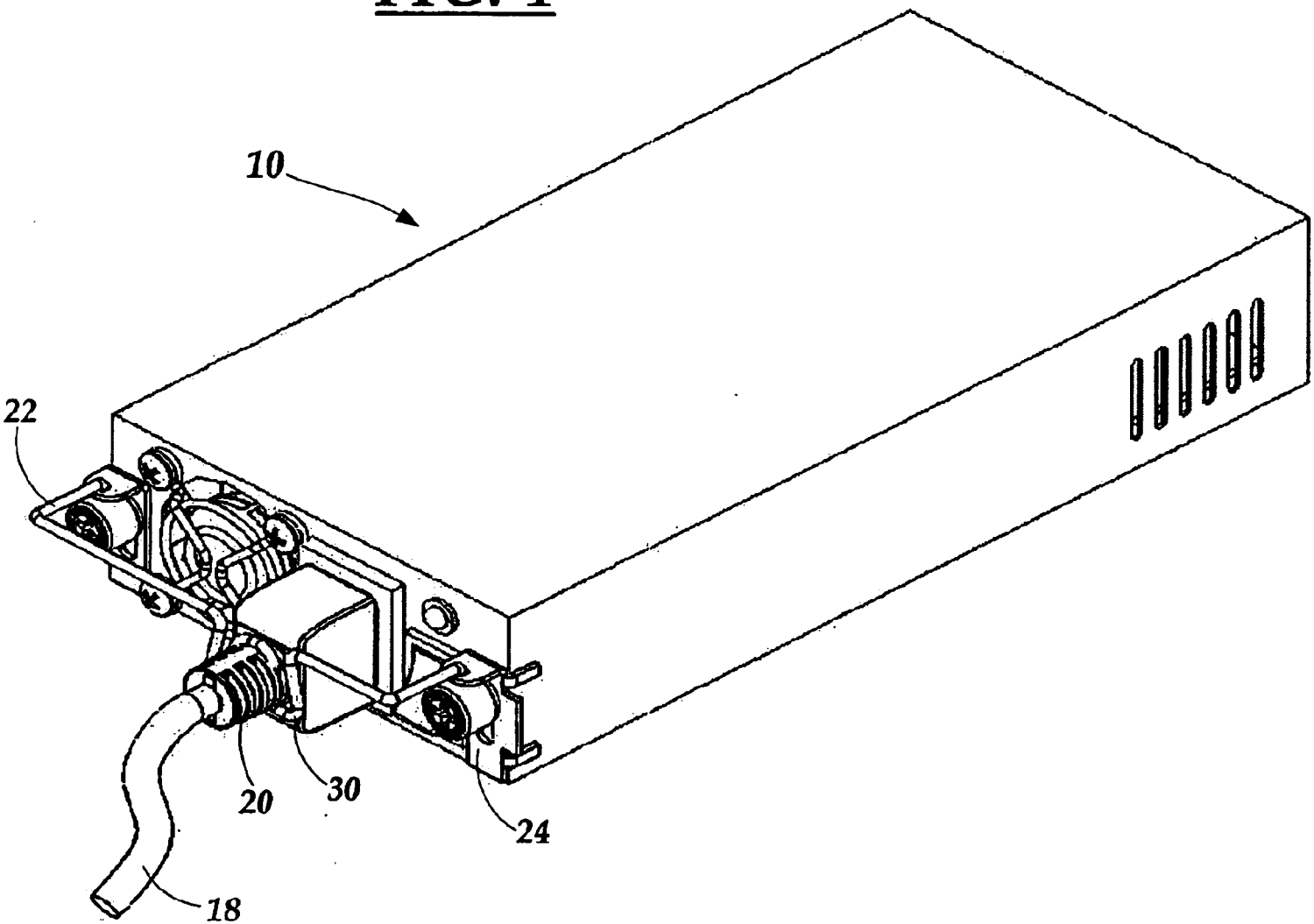
FIG. 4 is a perspective view of the retention arm in a locked position in an illustrative operating environment for the present invention.

Turning now to FIGS. 3 and 4, perspective views of the retention arm 22 in unlocked and locked positions will be described. According to the various embodiments, retention arm 22 should be positioned so that the locking member 30 is aligned to the cable 18 when the arm 22 is attached to the power supply 10. As shown in FIG. 3, the retention arm 22 may pivot in the retaining brackets 24 so that the locking member 30 is disengaged from the cable 18. In this unlocked position, the cable 18 may be removed from the receptacle 16.

As shown in FIG. 4, the retention arm 22 may also pivot in the retaining brackets 24 so that the locking member 30 engages with the strain relief 20 of cable 18. The retaining tabs 31 and 32 of the locking member 30 engage the sides of the cable 18 to prevent the cable 18 from being removed inadvertently from the receptacle 16.

As described herein, a cable retention apparatus is provided for retaining a cable to the power supply of an electronic device. It will be apparent to those skilled in the art that various modifications or variations may be made in the present invention without departing from the scope or sprit of the invention. Other embodiments of the invention will be apparent to those skilled in the art from consideration of the specification and practice of the invention disclosed herein.

I claim:

1. An apparatus for retaining a cable in a power supply of an electronic device, the apparatus comprising:

an arm having a first end and a second end, wherein at least one end of the arm is pivotally connected to the power supply device for movement from an unlocked position, wherein the arm is disengaged from the cable, to a locked position, wherein the arm is engaged with the cable, such that when the arm is engaged the cable is prevented from being removed from the power supply in the electronic device, wherein the cable comprises a plug and a cord; and a non-linear locking member, extending from the arm, to which the cord is engaged in a friction fit when the arm is in the locked position, wherein the non-linear locking member comprises two retaining tabs, wherein each tab is adjacent to a side of the cord when the arm is in the locked position.

2. The apparatus of claim 1, further comprising a retaining bracket integrated with the power supply to receive the end of the arm such that the arm is pivotally connected to the power supply.

3. The apparatus of claim 1, wherein the electronic device is a rack-mounted server.

4. The apparatus of claim 1, wherein the cable comprises a strain relief to which the arm is engaged when the arm is in the locked position.

5. A cable retention apparatus for a power supply in a rack-mounted server, comprising:

an arm, having a first end and a second end, wherein the ends of the arm are pivotally connected to the power supply for movement towards a receptacle within the power supply from an unlocked position, wherein the arm is disengaged from the cable, to a locked position, wherein the arm is engaged with the cable, such that when the arm is engaged the cable is prevented from being removed from the receptacle within the power supply of the rack-mounted server, wherein the cable comprises a plug and a cord, wherein the arm comprises a non-linear locking member extending from the arm to which the cord is engaged in a friction fit when the arm is in the locked position, wherein the non-linear locking member comprises two retaining tabs wherein each tab is adjacent to a side of the cord when the arm is in the locked position.

6. The cable retention apparatus of claim 5, wherein a pair of retaining brackets integrated with the power supply device receive each end of the arm such that the arm is pivotally connected to the power supply.

7. The cable retention apparatus of claim 6, wherein a pair of retaining screws is used to attach the retaining brackets to the power supply.

8. The cable retention apparatus of claim 5, wherein the cable comprises a strain relief to which the arm is engaged when the arm is in the locked position.

9. The cable retention apparatus of claim 5, wherein the non-linear locking member is formed as a substantially Greek capital letter omega in plain view between the two retaining tabs.

10. A system for retaining a cable in a power supply in an electronic device, comprising:

a pair of retaining brackets attached to each end of the power supply; and an arm having a first end and a second end, the ends of the arm pivotally connected to the retaining brackets for movement towards a receptacle within the power supply from an unlocked position, wherein the arm is disengaged from the cable, to a locked position, wherein the arm is engaged with the cable, such that when the arm is engaged, the cable is prevented from being removed from the receptacle within the power supply of the electronic device, wherein the cable comprises a plug and a cord, wherein the arm comprises a non-linear locking member extending from the arm to which the cord is engaged in a friction fit when the arm is in the locked position.

11. The system of claim 10, wherein the electronic device is a rack-mounted server.

12. The system of claim 10, wherein the cable comprises a strain relief to which the arm is engaged when the arm is in the locked position.

13. An apparatus for retaining a cable, the apparatus comprising:

a cable, wherein the cable comprises a plug and a cord; and a unitary arm, having a first end and a second end, the ends pivotally connected to a substantially planar surface engaged with the cable wherein the arm comprises a non-linear locking member to which the cord is engaged in a friction fit when the ends of the arm are pivoted towards the cable.

14. The apparatus of claim 13, wherein the cable comprises a strain relief to which the non-linear locking member is engaged when the ends of the arm are pivoted towards the cable.

15. A retaining device, comprising:

an arm having a first end and a second end, at least one end of the arm pivotally connected to a portion of a stationary surface adapted to have a cable detachably connect thereto, the arm pivotally movable between an unlocked position, in which the arm is spaced apart from the cable when the cable is connected to the stationary surface, and a locked position, in which the arm is engaged with the cable so that the cable is prevented from being separated from the stationary surface, wherein the cable comprises a plug and a cord; and a non-linear locking member extending from the arm to which the cord is engaged in a friction fit when the arm is in the locked position, the non-linear locking member comprising two retaining tabs, wherein each tab is positioned adjacent a side of the cord when the arm is in the locked position.

16. The device of claim 15, wherein the stationary surface is a power supply, the power supply further comprising two brackets that are each adapted to pivotally receive one respective end of the arm.

17. The retaining device of claim 15, wherein the non-linear locking member is formed as a substantially Greek capital letter omega in plain view between the two retaining tabs.

18. A retaining device, comprising:

a cable, wherein the cable comprises a plug and a cord; and an arm having a first end, a second end, and a non-linear portion, at least one end of the arm pivotally connected to a portion of a stationary surface adapted to have the cable detachably connect thereto, the arm pivotally movable between an unlocked position, in which the arm is spaced apart from the cable when the cable is connected to the stationary surface, and a locked position, in which the non-linear portion of the arm is engaged with the cord in a friction fit so that the cable is prevented from being separated from the stationary surface, wherein the cord comprises a strain relief to which the non-linear portion of the arm is engaged when in the locked position.

19. The device of claim 18, wherein the stationary surface is a power supply, the power supply further comprising two brackets that are each adapted to pivotally receive one respective end of the arm.

* * * * *